United States Patent [19]

Stolz

[11] Patent Number: 4,865,325

[45] Date of Patent: Sep. 12, 1989

[54] JIGSAW PUZZLE SUPPORT AND STORAGE BOARD

[76] Inventor: Larry W. Stolz, 2119 E. 16th St., Fremont, Nebr. 68025

[21] Appl. No.: 261,683

[22] Filed: Oct. 24, 1988

[51] Int. Cl.[4] ..... A63F 9/10

[52] U.S. Cl. ..... 273/157 R; 108/35; 108/63

[58] Field of Search ..... 273/157 R, 309; 108/34, 108/35, 63, 67, 90, 112

[56] References Cited

U.S. PATENT DOCUMENTS

| | | | |
|---|---|---|---|
| 1,167,905 | 1/1916 | Kreczkowski | 108/63 |
| 1,363,062 | 12/1920 | Steere | 108/34 X |
| 1,941,558 | 1/1934 | Labbe | 273/157 R |
| 2,506,189 | 5/1950 | Attridge | 273/157 R |
| 3,741,548 | 6/1973 | Kaupp | 273/157 R |
| 3,792,668 | 2/1974 | Ward | 108/69 |
| 4,436,307 | 3/1984 | Caldwell | 273/157 R |

FOREIGN PATENT DOCUMENTS

| | | | |
|---|---|---|---|
| 972577 | 8/1950 | France | 273/157 R |
| 2418661 | 11/1979 | France | 273/157 R |
| 650175 | 2/1951 | United Kingdom | 273/157 R |
| 2056865 | 3/1981 | United Kingdom | 273/157 R |

*Primary Examiner*—Anton O. Oechsle

*Attorney, Agent, or Firm*—Zarley, McKee, Thomte, Voorhees & Sease

[57] ABSTRACT

A jigsaw puzzle support and storage board includes a base with a table portion upon which a puzzle may be assembled. A peripheral wall around the table portion forms a cavity, with the table portion forming the bottom thereof. A pair of bi-fold doors are operably mounted to opposite ends of the base, and will move between a closed position completely covering the table portion, and an open position fully revealing the table portion. The panels of the bi-fold doors are hinged such that when the doors are moved upwardly and outwardly to reveal the cavity, the panels will stack on top of one another adjacent the cavity. A resilient material covers the lower surfaces of the bi-fold doors so as to bias puzzle pieces against the table portion (when the bi-fold doors are closed) and thereby hold the puzzle pieces in position during transport of the device. Each bi-fold door has a storage container mounted therein located on adjacent panels so as to be in close proximity when the doors are in a closed position. A single lid is removably affixed to both storage containers with a fastener to lock the lid in place. Operable fasteners selectively hold the panels of each bi-fold door in the closed position.

6 Claims, 3 Drawing Sheets

JIGSAW PUZZLE SUPPORT AND STORAGE BOARD

TECHNICAL FIELD OF THE INVENTION

This invention relates generally to a jigsaw puzzle support, and more specifically to a puzzle support device which allows for storage and support of a puzzle in various states of assembly as well as for storage of the puzzle's component pieces.

BACKGROUND OF THE INVENTION

While there are many types of jigsaw puzzle support and storage boards known in the prior art, they still suffer several drawbacks when used as a support and storage means. Within the prior art, there are two basic and distinct types of puzzle support and storage boards, a box-like type and an easel-like device.

The predominant box-like type is constructed of two generally planar surfaces joined by an operable hinge. One surface has a cavity which serves as an assembly tray, while the other surface usually includes one or more panels which serve as doors to the cavity. The device thereby opens much like a book, or the like.

A second type of jigsaw puzzle support which utilizes a box-like construction consists of an upper and lower horizontal surface which are removably connected. In this construction, the upper horizontal surface serves as a lid for the cavity within the lower horizontal surface.

The second general type of jigsaw puzzle support consists of an easel-like device, such as those devices disclosed in U.S. Pat. No. 2,506,189 to Attridge and U.S. Pat. No. 3,741,428 to Kaupp. The primary purpose of these devices is to provide a generally vertical surface on which the person can easily view the pieces of the puzzle as they are being assembled. However, the easel-like jigsaw puzzle support board suffers from the limitation that it does not allow for a secure means for transportation of a jigsaw puzzle.

While the box-like puzzle supports are more secure and easier to transport than the easel devices, they suffer from the limitation of having to provide a large working space with which to open the lid to use the device. In contrast, the easel-like puzzle storage and support device allows the user to utilize the entirety of the surface for puzzle assembly, but lacks appropriate space and facilities for storage of the unassembled portions of the puzzle in a secure fashion.

It is therefore an object of the present invention to provide an improved jigsaw puzzle support and storage board.

Another object of the present invention is to provide a jigsaw puzzle support and storage board which will allow the individual assembling the jigsaw puzzle to utilize the full surface of the board for jigsaw assembly.

An additional object is to reduce the amount of space required for a puzzle support board.

Another object of the present invention is to provide a jigsaw puzzle support and storage board which will allow for storage of the pieces of the jigsaw puzzle during assembly.

A further object of the invention is to provide a jigsaw puzzle support and board which will allow for ease and transportability of a jigsaw puzzle which is partially assembled, and to provide convenient storage of those pieces of the puzzle which have not been incorporated into the puzzle.

These and other objects will be apparent to those skilled in the art.

SUMMARY OF THE INVENTION

The jigsaw puzzle support and storage board of this invention includes a base with a table portion upon which a puzzle may be assembled. A peripheral wall around the table portion forms a cavity, with the table portion forming the bottom thereof. A pair of bi-fold doors are operably mounted to opposite ends of the base, and will move between a closed position completely covering the table portion, and an open position fully revealing the table portion. The panels of the bi-fold doors are hinged such that when the doors are moved upwardly and outwardly to reveal the cavity, the panels of each door will stack on top of one another in accordion fashion, adjacent each side of the cavity. A resilient material covers the lower surface of the bi-fold doors so as to bias puzzle pieces against the table portion (when bi-fold doors are closed) and thereby hold the puzzle pieces in position during transport of the device.

Each bi-fold door has a storage container mounted thereon for holding loose pieces of the jigsaw puzzle. The storage containers are located on adjacent panels of the two doors so as to be in close proximity when the doors are in a closed position. These storage containers have a lid which is removably affixed thereto and which is of a length to cover both storage containers. A fastener locks the lid in place. The bi-fold doors operate so as to maintain the storage containers in an upright condition when the doors are being opened and closed. Operable fasteners hold the panels of each bi-fold door in the closed position, to further secure the doors.

DESCRIPTION OF THE PREFERRED EMBODIMENT

Figure 1:
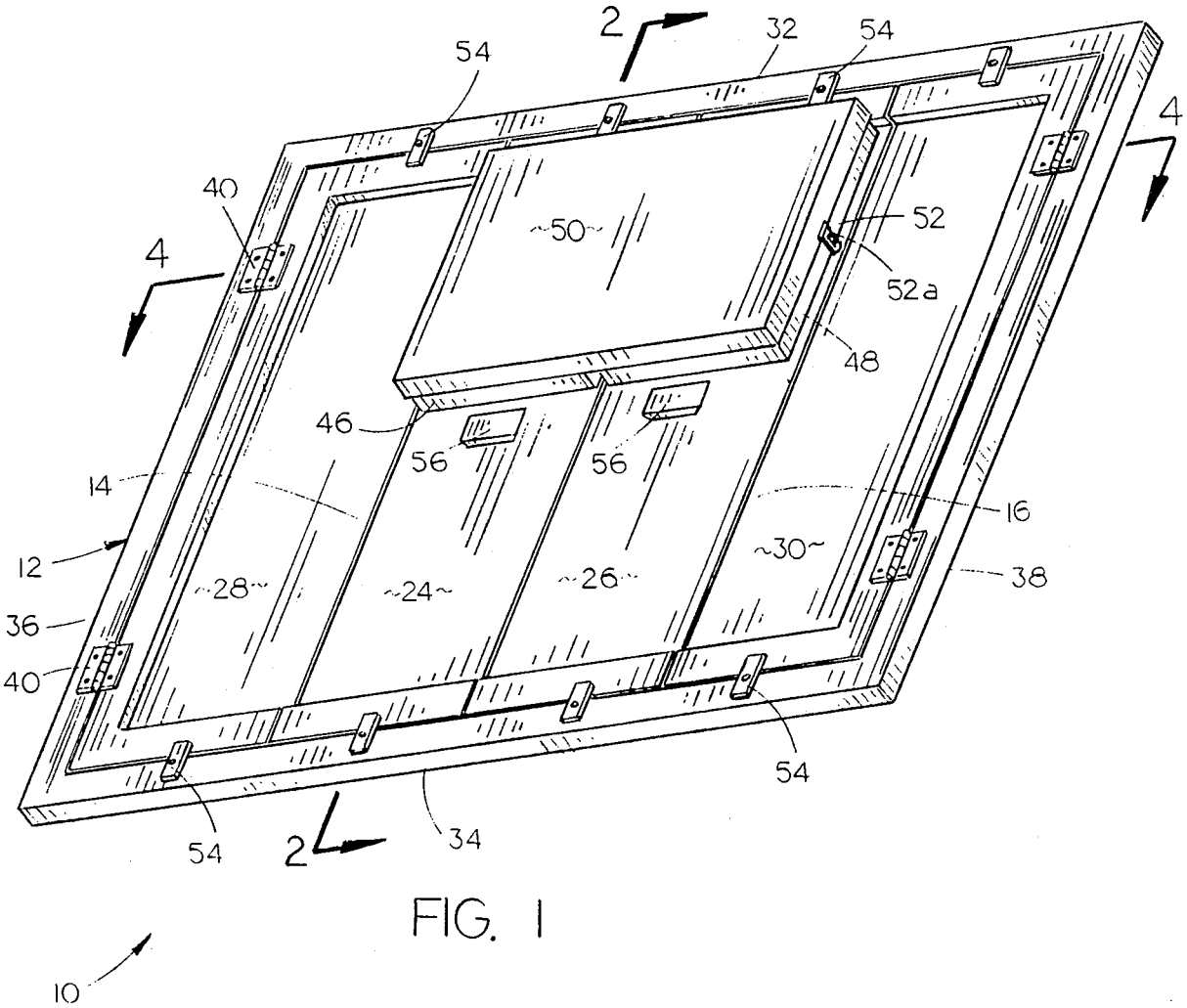
FIG. 1 is a perspective view of the invention, with the doors in a closed position.

Referring now to the drawings, in which identical or corresponding parts are identified by the same reference numeral, and more particularly to FIG. 1, the jigsaw puzzle support and storage board of this invention is identified generally at 10 and includes a base 12 having a pair of bi-fold doors 14 and 16 mounted thereon.

Base 12 includes a flat, horizontal assembly table 16 with a wall 18 extending around the peripheral edge thereof to form a cavity 20. The lower surfaces of bi-fold doors 14 and 16 have a resilient material 22 covering the surface, as described in more detail hereinbelow.

Bi-fold doors 14 and 16 each include an inner panel 24 and 26, respectively, and an outer panel 28 and 30, respectively. In order to more easily describe the invention, the puzzle board will be described as having upper and lower sides 32 and 34, respectively, and opposing ends 36 and 38. The outer panels 28 and 30 are those panels adjacent ends 36 and 38, as shown in the drawings. The inner panels 24 and 26 are those panels most closely adjacent to the center of the puzzle support 10. Since bi-fold doors 14 and 16 are mirror images, only bi-fold door 14 will be described in detail hereinbelow.

Figure 3:
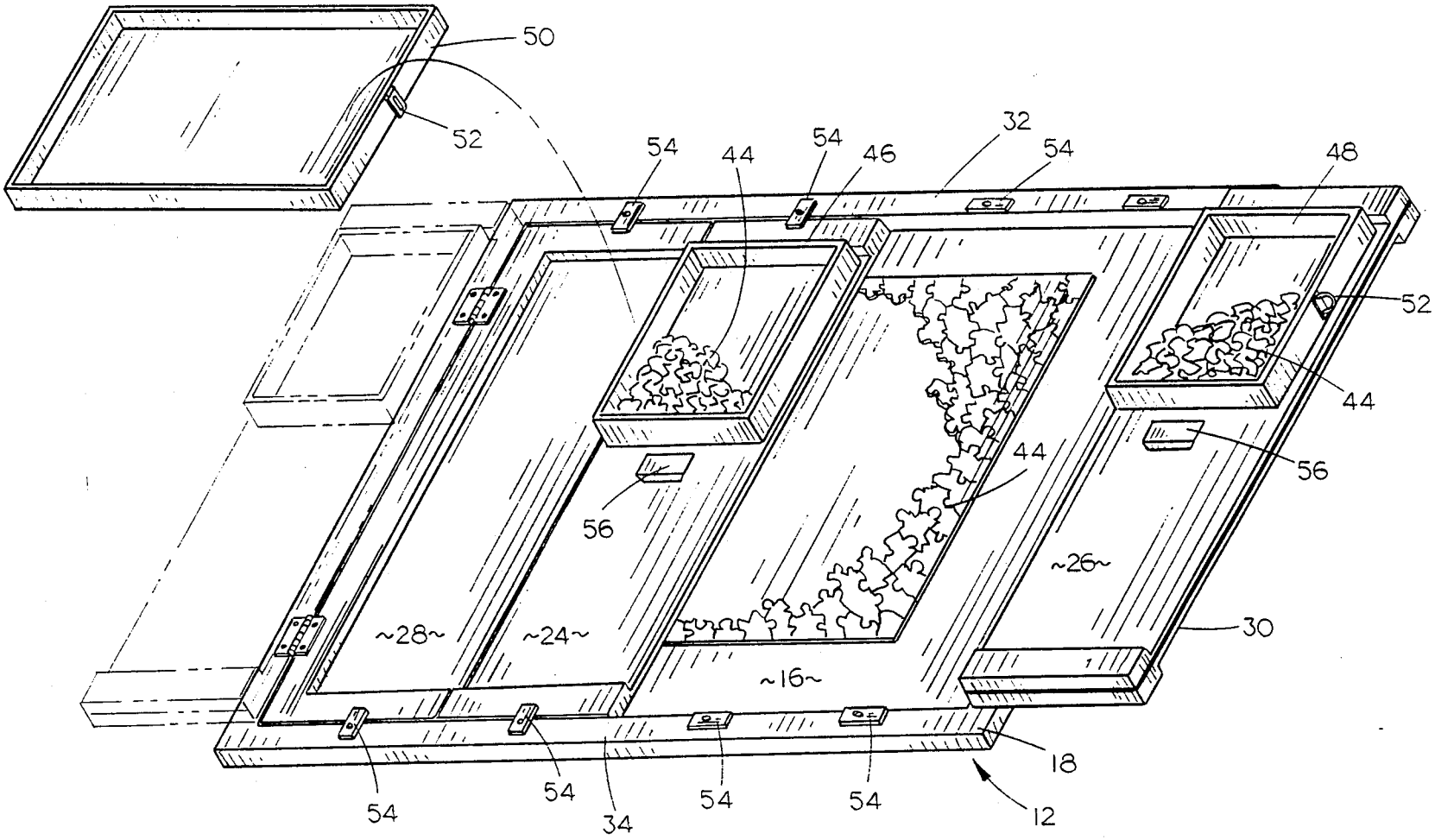
FIG. 3 is a perspective view of the invention, with one of the doors in an open position and the other door in a closed position.

Bi-fold door 14 has its outer panel 28 pivotally connected to wall 18 at end 36 via a pair of hinges 40. Outer panel 28 is connected so as to pivot upwardly out of cavity 20 to a horizontal position extending outwardly from wall 18 (see FIG. 3). Inner panel 24 is connected to outer panel 28 with a strip of resilient adhesive tape 42, such that panel 24 may be maintained in a horizontal orientation all the while bi-fold door 14 is moved from a closed position to an open position. Thus, in the open position, inner panel 24 is stacked atop outer panel 28 in accordion-like fashion, as seen in the broken-line position of FIG. 3. A strip of adhesive tape 42 was found to be the most convenient material for creating the hinged connection between panels 24 and 28. Obviously, other forms of hinges would work equally as well. FIG. 3 shows both the opened and closed position for bi-fold doors 14 and 16.

Figure 2:
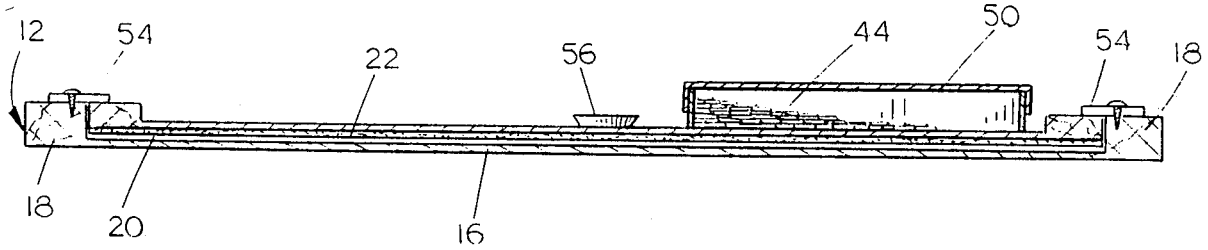
FIG. 2 is a sectional view of the invention, taken at lines 2—2 in FIG. 1.
Figure 4:
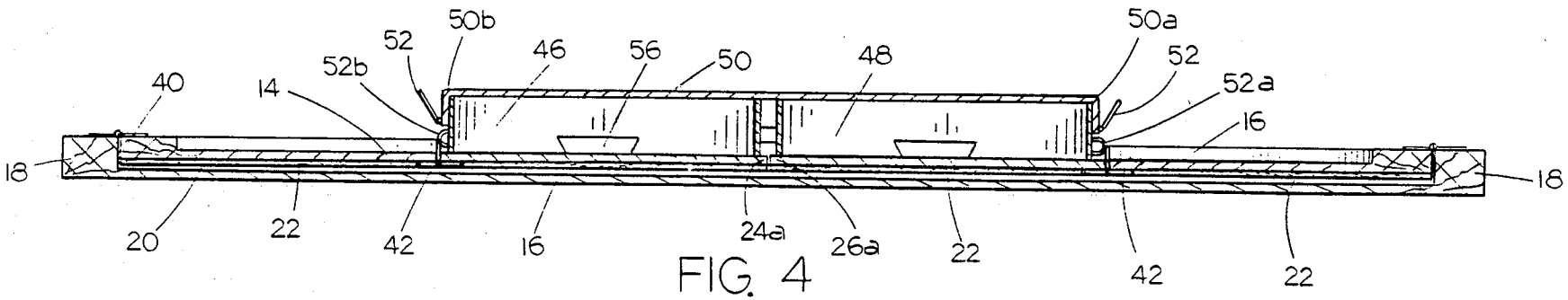
FIG. 4 is a sectional view of the invention taken at lines 4—4 at FIG. 1.
Figure 5:
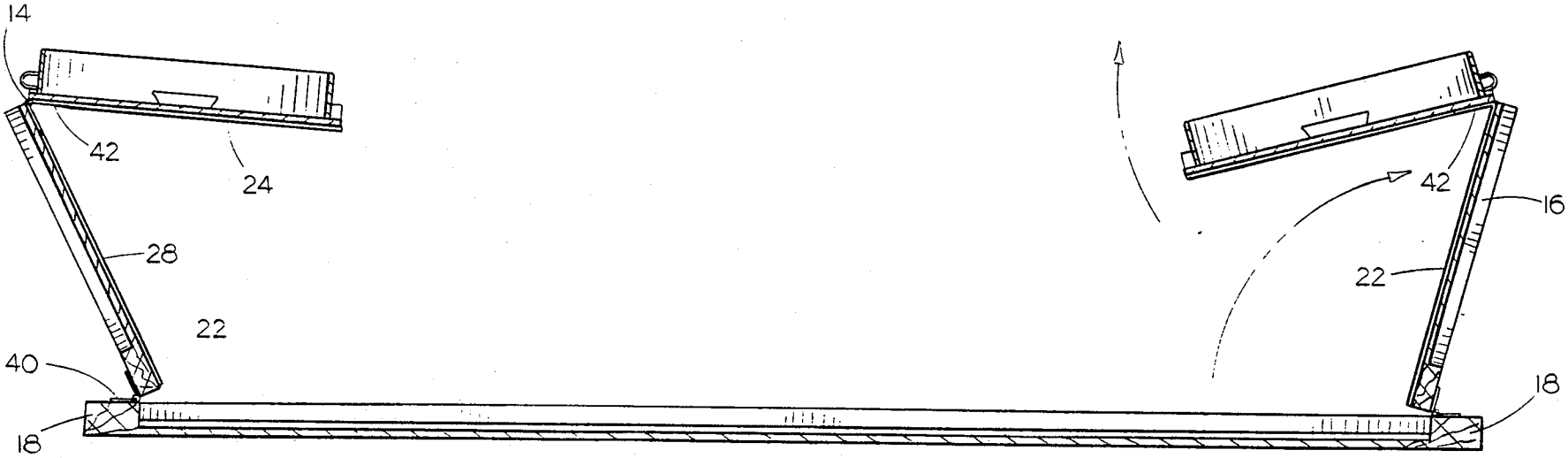
FIG. 5 is a sectional view of the invention similar to that of FIG. 4 but with the doors in a partially raised condition.

Referring now to FIGS. 2 and 4, it can be seen that bi-fold door 14 is of a thickness less than the depth of cavity 20 and located such that the bottom resilient material 22 on the surface of bi-fold doors 14 will push against puzzle pieces 44 arranged on table portion 16. This will cause the puzzle pieces to be held securely in position pressed into resilient material 22.

Inner panels 24 and 26 have a rectangular storage container 46 and 48 mounted to their upper surfaces closely adjacent their inner edges 24*a* and 26*a*. Storage containers 46 and 48 are mounted in alignment such that a single lid 50 may be secured across the top of both storage containers 46 and 48, when bi-fold doors 14 and 16 are in a closed position. A latch 52 is mounted on each end 50*a* and 50*b* of lid 50 so as to correspond with a latch pin 52*a* on storage container 48 and a latch pin 52*b* mounted on storage container 46. Lid 50 may thereby be latched into a secured position on storage containers 46 and 48, thereby holding bi-fold doors 14 and 16 in a closed position.

A series of rectangular fasteners 54 are arranged along the top of wall 18 along upper and lower edges 32 and 34 of puzzle board 10. At least one fastener is mounted adjacent the upper and lower edges of each panel 24, 26, 28 and 30, as shown in the drawings. Fasteners 54 are elongated rectangular members which are rotatably fastened so as to be rotatable from a secured position overlapping the adjacent panel, and an unsecured position rotated 90° from the secured position (such that the fastener does not overlap the adjacent panel). Fasteners 54 will thereby assist in further securing each bi-fold door 14 and 16 in the closed position for transport. A handle 56 is mounted on each inner panel 24 and 26 to assist in opening and closing bi-fold doors 14 and 16.

Whereas the invention has been shown and described in connection with the preferred embodiments thereof, it will be understood that many modifications, substitutions and additions may be made which are within the intended broad scope of the appended claims. For example, various types of hinges may be utilized for connecting panels 24 through 30 and bi-fold doors 14 and 16. Similarly, a variety of resilient materials may be utilized on the lower surfaces of bi-fold doors 14 and 16. Thus, it can be seen that the invention fulfills at least all of the above stated objectives.

I claim:

1. A jigsaw puzzle support and storage board comprising:

a base having a table portion, the table portion adapted for use an assembly area for a puzzle, a wall projecting upwardly from said base around the periphery of said table portion;

a pair of doors operably mounted to said wall and operable between a closed position in which the doors fully cover said table area, and an open position wherein the cavity is fully revealed, said doors being mounted so as to create a gap, when in said closed position, between a lower surface of said doors and the table portion, to accommodate a puzzle piece there-between;

each said door including an inner and outer panel, said outer panels of said door being pivotally mounted to said wall and opposite one another, and said inner panels being pivotally mounted to said outer panels.

2. The jigsaw puzzle support and storage board of claim 1, further comprising selectively operable fastener means affixed to said wall for selectively securing said doors in the closed position.

3. The jigsaw puzzle support and storage board of claim 1, wherein said doors include upper and lower surfaces, and further comprising a resilient material layer covering the lower surfaces of said doors.

4. The jigsaw puzzle support and storage board of claim 1, further including a storage container means affixed to the inner panel of each said door, and a single lid adapted to removably cover the storage containers on both doors, when said doors are in the closed position.

5. The puzzle board of claim 4, further comprising operable latch means mounted to said lid and latch pin means affixed to said containers, said latch means and latch pin means being selectively cooperable to lock the lid to the containers.

6. The jigsaw puzzle support and storage board of claim 1, wherein said inner and outer panels of each said door are pivotally mounted such that the panels of each door assume a horizonal position with the inner panels stacked atop the outer panels and with the outer panels extending outwardly from said wall when said doors are in the open position, the inner panels capable of maintaining a horizontal orientation while said doors are operated between said closed and open positions.

* * * * *